US006282369B1

(12) United States Patent
Maier et al.

(10) Patent No.: US 6,282,369 B1
(45) Date of Patent: Aug. 28, 2001

(54) FACIAL SAUNA WITH TWO VAPOR DELIVERY MEANS COMPRISING DIFFERENT VAPOR DELIVERY NOZZLES

(75) Inventors: Michael Maier, München (DE); Joachim Schrettlinger, Kalgenfurt; Bernd Kruschitz, Ludmannsdorf, both of (AU)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/561,507

(22) Filed: Apr. 27, 2000

(30) Foreign Application Priority Data

Apr. 29, 1999 (EP) ..... 99890136

(51) Int. Cl.[7] ..... A61H 33/12; C10K 15/00

(52) U.S. Cl. ..... 392/403; 261/139

(58) Field of Search ..... 392/386, 394, 392/396, 397, 398, 404, 405, 406, 403; 261/139, 142, DIG. 65

(56) References Cited

U.S. PATENT DOCUMENTS

| | | | | |
|---|---|---|---|---|
| 2,467,393 | * | 4/1949 | Leher | 392/403 |
| 3,351,737 | * | 11/1967 | Katzman et al. | 392/406 |
| 4,190,052 | * | 2/1980 | McCarthy | 392/403 |
| 4,300,556 | * | 11/1981 | Ochi et al. | 604/291 |
| 4,399,349 | | 8/1983 | Deming et al. | 392/403 |
| 5,010,905 | * | 4/1991 | Snyder et al. | 132/272 |
| 5,098,414 | * | 3/1992 | Walker | 604/289 |
| 5,607,409 | * | 3/1997 | John | 604/291 |

* cited by examiner

*Primary Examiner*—Sang Paik
(74) *Attorney, Agent, or Firm*—Ernestine C. Bartlett

(57) ABSTRACT

A facial sauna comprises a first vapor delivery systems and a second vapor delivery system, each designed for delivering water vapor in the form of a vapor jet. The first vapor delivery system delivers a thicker vapor jet through a first vapor delivery nozzle. The second vapor delivery delivers a thinner vapor jet through a second vapor delivery nozzle. While in operation, the first vapor delivery nozzle of the first vapor delivery system is at a smaller distance from a vapor outlet of the facial sauna than is the second vapor delivery nozzle of the second vapor delivery system.

6 Claims, 2 Drawing Sheets

FACIAL SAUNA WITH TWO VAPOR DELIVERY MEANS COMPRISING DIFFERENT VAPOR DELIVERY NOZZLES

The invention relates to a facial sauna as defined in the preamble of claim 1.

BACKGROUND OF THE INVENTION

Such a facial sauna is known, for example, from the patent document U.S. Pat. No. 4,399,349 A. The known facial sauna is fitted with a total of four vapor delivery means of different construction, i.e. one substantially cup-shaped vapor delivery mask, one vapor delivery tube with an open end, one vapor delivery tube with an end closed by a brush, and one vapor delivery tube with an end closed by a piece of foam material. When the known facial sauna is used with the vapor delivery mask, which issues a wide jet of vapor, a user will position his/her face at a distance to the vapor delivery mask which is felt to be comfortable. When using the facial sauna with the vapor delivery nozzle with open end, which gives off a comparatively narrow vapor jet, a user must approach with his/her face considerably more closely to the facial sauna so as to utilize the comparatively concentrated vapor jet for the treatment of only a small skin portion, as desired, which has the result that the user must bend more closely towards the facial sauna which is, for example, positioned on a table surface, which in its turn leads to a less comfortable body position and may lead to painful muscular tensions in the back region in the case of a longer period of use.

SUMMARY OF THE INVENTION

The invention has for its object to reduce substantially or even eliminate completely the disadvantages indicated above and to provide an improved facial sauna which guarantees a comfortable body position during its use at all times.

To achieve the above object, a facial sauna as defined in the preamble of claim 1, according to the invention, is characterized in that the features defined in the characterizing part of claim 1 are present.

The measures according to the invention achieve in a very simple manner that, when using the facial sauna, a user can always occupy the same position relative to the facial sauna with his/her face independently of the use of one or the other of the two vapor delivery means, i.e. can always assume and maintain the same, personally comfortable body position, so that a relaxed utilization of the facial sauna is achieved at all times and unpleasant physical loads are prevented. The measures according to the invention indeed achieve in a particularly simple manner that, when a thin vapor jet of comparatively small diameter is generated, i.e. a concentrated vapor jet for the treatment of special skin portions—for example the transition portion between the nose and the forehead—, the production of this thin vapor jet takes place at a comparatively great distance from the facial sauna, and accordingly at a comparatively small distance from the skin portion to be treated, so that the thin vapor jet makes contact with the skin portion to be treated in a concentrated form while the user occupies a pleasant and comfortable body position.

The distance ratios as specified in claims 2 and 3 have been found to be particularly advantageous in a facial sauna according to the invention. This has been demonstrated in practical tests.

The construction of a facial sauna according to the invention may be such that one or the other of the two vapor delivery means may be connected to the vapor outlet of the facial sauna, as desired. It was found to be particularly advantageous, however, if in addition the features as defined in claim 4 are provided in a facial sauna according to the invention. A particularly simple handling is thus achieved in such a facial sauna according to the invention, because the first vapor delivery means can remain permanently connected to the vapor outlet, and only the second vapor delivery means must be handled, i.e. is to be provided on the first vapor delivery means if a thinner vapor jet instead of a wider vapor jet is desired.

In a facial sauna according to the invention in which the second vapor delivery means can be coupled to the first vapor delivery means, in particular can be pushed home onto the latter, it was found to be particularly favorable when in addition the features of claims 5 and 6 are provided. The measures according to claim 5 safeguard a secure coupling of the second vapor delivery means to the first vapor delivery means. Furthermore, the measures of claim 6 achieve that water condensation which may be formed in the second vapor delivery means can flow back through the at least one water return channel into the interior of the facial sauna.

The above and further aspects of the invention will become clear from the following description of an embodiment and are explained in more detail with reference to this embodiment.

BRIEF DESCRIPTION OF THE DRAWINGS

The invention will be explained in more detail below with reference to an embodiment shown in the drawings; however, the invention is by no means limited to this embodiment.

DESCRIPTION OF THE PREFERRED EMBODIMENTS

Figure 1:
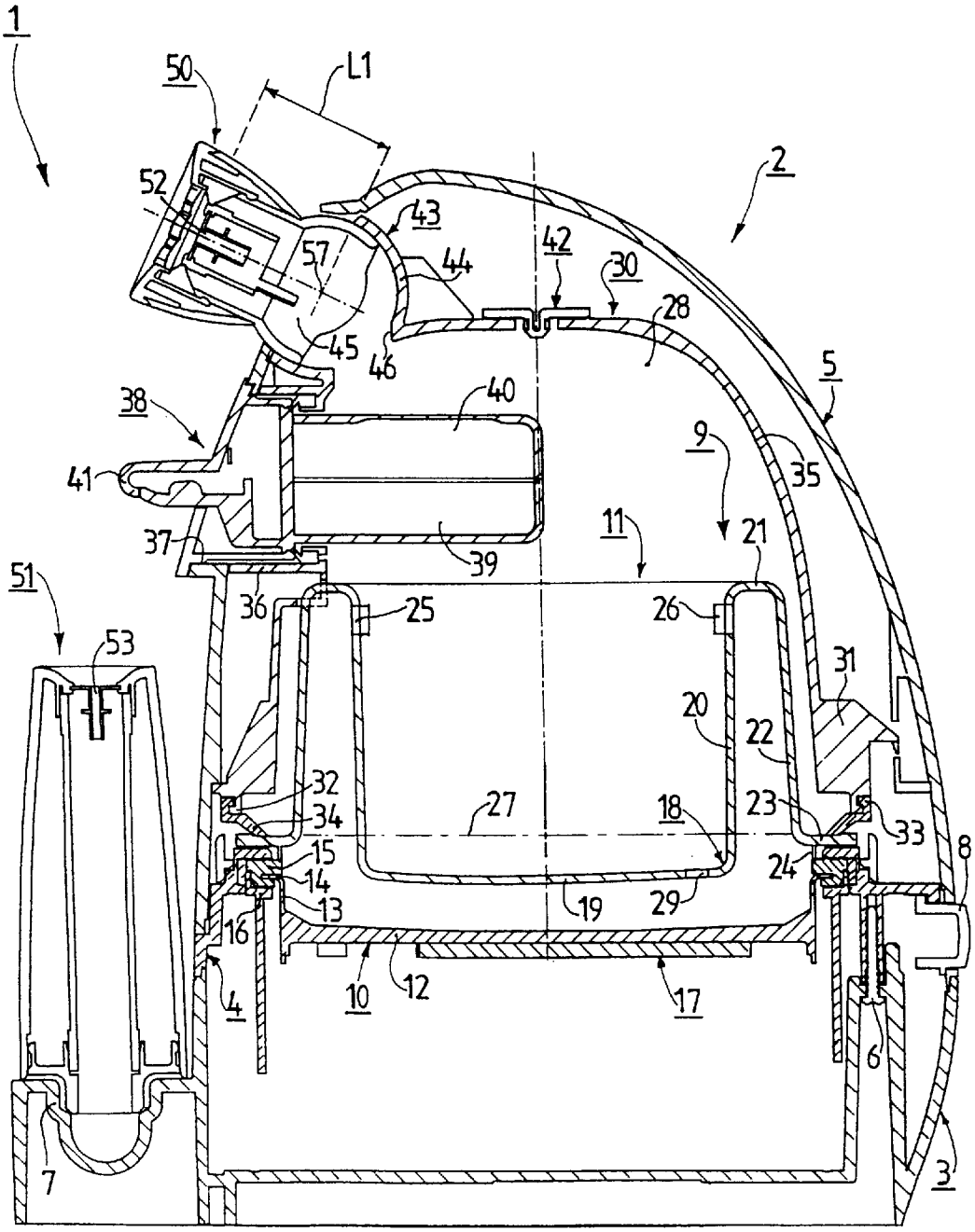
FIG. 1 shows somewhat diagrammatically in cross-section a facial sauna in a first embodiment of the invention, where a first vapor delivery means is connected to a vapor outlet of the facial sauna.

FIG. 1 shows a facial sauna 1. The facial sauna 1 is constructed for generating and delivering water vapor for the treatment of facial skin. The facial sauna 1 comprises a housing 2. The housing 2 consists of a base part 3 and an intermediate part 4 as well as a dome-type upper part 5. The base part 3 and the intermediate part 4 are interconnected by means of screws, one screw 6 of these being visible in FIG. 1. The base part 3 comprises a receptacle 7 which is designed for accommodating a vapor delivery means, which vapor delivery means will be discussed in more detail further below. The upper part 5 of the housing 2 can be mounted on the intermediate part 4 and the base part 3 and can be retained thereon after being mounted by locking means which are not shown. The upper part 5 can also be removed from the intermediate part 4 and the base part 3 again, for which removal an unlocking button 8 is to be operated, which operation causes the locking means mentioned above to become unlocked, whereupon the upper part 5 can be lifted from the intermediate part 4 and the base part 3.

The interior of the housing 2 accommodates a reservoir configuration 9 which consists of a cup-shaped lower reservoir part 10 and an upper reservoir part 111. The lower reservoir part 110 comprises a bottom wall 12, a hollow cylindrical side wall 13 integrally connected to the bottom wall 12, and a base flange 14 which projects radially outwards from the side wall 13. An annular first sealing 15 of substantially U-shaped cross-section is provided over the base flange 14. The first sealing 15 bears directly on a portion 16 of the lower housing part 3. An intermediate ring 16 is laid on the first sealing 15.

It should be noted that a heating device 17 is connected to the bottom wall 12, indicated diagrammatically only in FIG. 1. The heating device 17 is formed by a resistance heating device in the present case, realized by means of PTC elements. The power supply for the heating device 17 is achieved by means of electric circuit means which are accommodated in a space 18 in the lower housing part 3, but which are not shown in Fig. for simplicity's sake because they are of no particular importance in the present context.

The upper reservoir part 11 consists of a cup part 18 which comprises a cup bottom wall 19 and a hollow cylindrical cup side wall 20. The cup side wall 20 merges into an upper wall 21 which extends radially outwards from the cup side wall 20. The upper wall 21 merges into a hollow cylindrical sleeve wall 22 which extends from the upper wall 21 towards the lower reservoir part 10. The sleeve wall 22 merges into a cover flange 23 which projects radially outwards from the sleeve wall 22. The lower reservoir part 11 bears on the intermediate ring 16 by its cover flange 23. A hollow cylindrical extension 24 projects from the cover flange 23 and bears with its free end on the U-shaped first sealing 15, so that in this manner a reliable sealing between the lower reservoir part 10 and the upper reservoir part 11 is achieved by means of the U-shaped first sealing 15.

It should be noted that two passages 25 and 26 formed by tangentially extending slots are provided in the hollow cylindrical side wall 20 in the region of the hollow cylindrical cup side wall 20 of the cup part 18 which is remote from the cup bottom wall 19. The two slots 25 and 26 are designed for allowing vapor and possibly foam to pass through. Such a passage may also be provided in the upper wall 21, in which case it can be used as an emptying spout as well.

When the facial sauna is used, water introduced into the reservoir configuration 9 up to a maximum level indicated with a dash-dot line 27 is heated by means of the heating device 17 to such an extent that vapor is generated. The generated vapor is conducted through the passages 25 and 26 into a-vapor chamber 28. Unwanted impurities in the water present in the reservoir configuration 9 may possibly lead to a foam generation during heating of the water. In this case, the generated foam will be forced through the passages 25 and 26 into the cup part 18, whereby the generated foam will be changed back into water again first owing to the forceful passage of the foam through the openings 25 and 26 and second owing to the lower temperature prevailing in the cup part 18. The water thus restored is added to the water present in the reservoir configuration 9 again, for which purpose a water return passage 29 is provided in the cup bottom wall 19 which also enables a passage of the restored water in the case of a water level in the reservoir configuration 9 such that the water level lies below the cup bottom wall 19.

A vapor collector dome 30 is provided in the interior of the housing 2 of the facial sauna 1, forming a boundary of the vapor chamber 28. The vapor collector dome 30 comprises a substantially hollow cylindrical base ring 31 which is retained in the upper part 5 of the housing in a manner not shown in any detail. At its side facing the lower housing part 3, the base ring 31 is provided with a circular projection 32 which has a hooked shape in cross-section. A circular second sealing 33 is laid against this projection 32, which sealing comprises a circular sealing tag 34 by means of which it bears on the cover flange 23 of the upper reservoir part 11, thus sealing off the vapor chamber 18 in this region. A dome-shaped upper wall 35 is connected to the base ring 31. The vapor collector dome 31 is connected to a connector 36 in the region of the upper wall 35, which connector extends up to an opening 37 in the upper housing part 5. The connector 36 is designed for holding an additive container 38 which can be passed through the opening 37 into the vapor chamber 28. The additive container 38 comprises a trough-shaped bottom part 39 and a cover-shaped upper part 40, which upper part 40 is provided with passages (not shown) through which aromatic substances and the like can enter the vapor chamber 28 inside the vapor collector dome 30. The additive container 38 is provided with a handle 41 by means of which the additive container 38 can be introduced into the connector 36 of the vapor collector dome 30 and can be pushed home right through this connector 36.

The vapor collector dome 30 is provided with a pressure relief valve 42, diagrammatically depicted in FIG. 1, in the region of the dome-shaped upper wall 35 remote from the lower housing part 3, which represents an advantageous safety measure.

The vapor collector dome 30 is provided with a vapor outlet 43 in the region of the dome-shaped upper wall 35 of the vapor collector dome 30 remote from the lower housing part 3. The vapor outlet 43 comprises an outlet wall 44 substantially shaped as a half shell which is integrally joined to the dome-shaped upper wall 35. The inner region 45 of the vapor outlet 43 bounded by the outlet wall 44 is in communication with the vapor chamber 28 via a passage 46.

The facial sauna 1 is fitted with two vapor delivery means 50 and 51 which can be connected to the vapor outlet 43 and through which the water vapor can be delivered in different ways. The construction of the facial sauna 1 is advantageously arranged such that a first vapor delivery means 50, shown in detail in FIG. 2, and a second vapor delivery means 51, shown in detail in FIG. 3, are each designed for delivering water vapor in the form of a vapor jet, and that here the first vapor delivery means 50 comprises a first vapor delivery nozzle 52 for supplying water vapor in the form of a first vapor jet with a comparatively great first diameter D1, and that the second vapor delivery means 51 comprises a second vapor delivery nozzle 53 for delivering water vapor in the form of a second vapor jet with a comparatively small second diameter D2. It was found in experiments that a first diameter D1 of nominally 3.5 mm and a second diameter D2 of nominally 2.0 mm are advantageous. Obviously, many other values are possible, for example 1.0 mm or 5.0 up to 10.0 mm. The diameter values indicated for the thinner vapor jet and for the thicker vapor jet relate to the location where the vapor jet issues from the relevant vapor delivery nozzle 52 or 53. It is obvious that, as the distance of a vapor jet to the exit point of the vapor delivery nozzle increases, the diameter of this jet will increase more or less strongly.

The first vapor delivery means 50 of the facial sauna 1 is directly connected to the vapor outlet 43. The second vapor delivery means can be or is indirectly connected to the vapor outlet 43, i.e. by means of the first vapor delivery means 50, which will be discussed in more detail further below.

Figure 2:
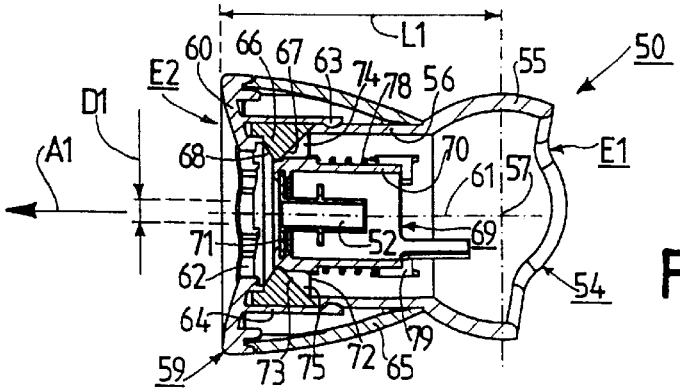
FIG. 2 is a cross-sectional view showing the first vapor delivery means of the facial sauna of FIG. 1.
Figure 3:
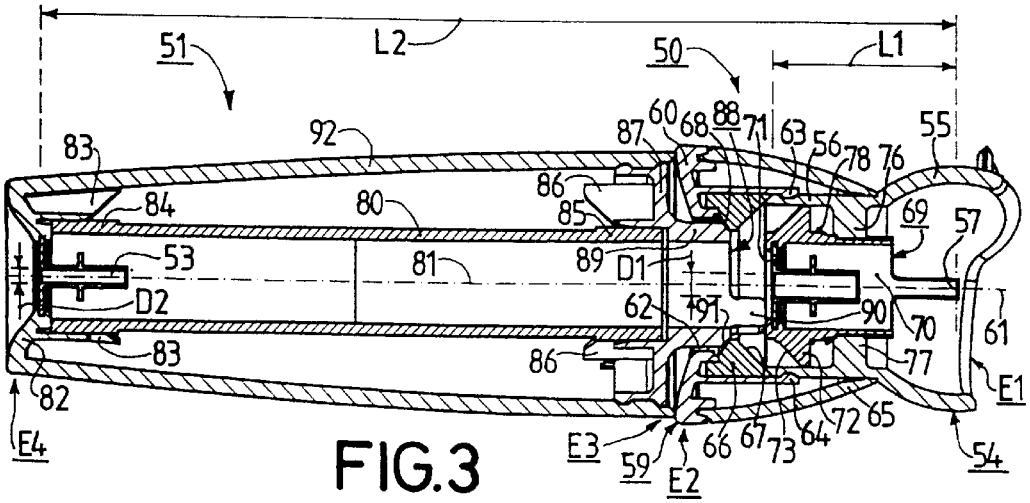
FIG. 3 is a cross-sectional view of the first vapor delivery means of FIG. 2 and of second vapor delivery means coupled to the first vapor delivery means of the facial sauna of FIG. 1.
Figure 4:
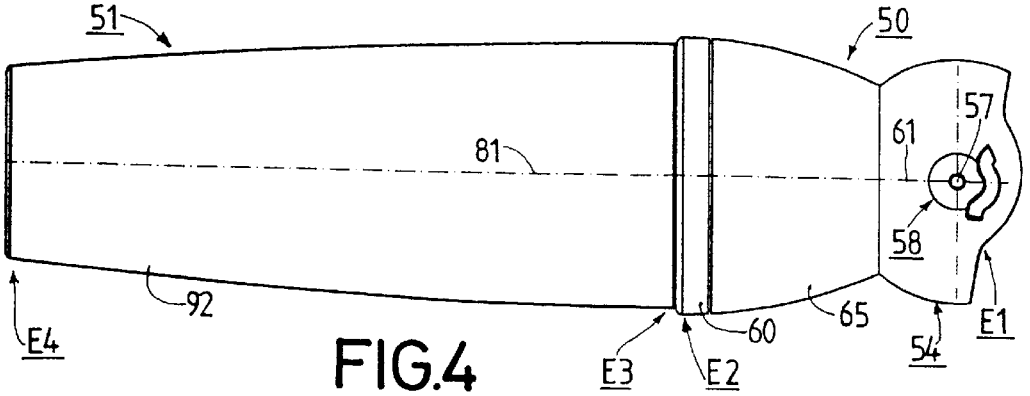
FIG. 4 is a lateral elevation of the two coupled vapor delivery means of FIG. 3.

As is apparent from FIG. 2, the first vapor delivery means 50 comprises at its one end E1 connection means 54 for connection to the vapor outlet 43. The connection means 54 comprise a bearing portion 55 substantially shaped as a sphere sector and a sleeve-shaped retaining portion 56 which is integrally joined to the bearing portion 55. The first vapor delivery means 50 is pivotably retained in the vapor outlet 43 by means of the bearing portion 55, i.e. pivotably about a pivot axis 57. The bearing portion 55 is provided with pivot bearing means 58 which project laterally, visible in FIG. 4, for the purpose of retaining the bearing portion 55, and thus the first vapor delivery means 50, pivotably about the pivot axis 57.

The first vapor delivery means 50 comprises at its other end E2 coupling means 59 which are designed for coupling to coupling means of the second vapor delivery means 51, which will be discussed in more detail further below. The coupling means 59 of the first vapor delivery means 50 consist of a coupling piece 60 which has a funnel-type construction and which comprises a passage 62 which is arranged so as to be coaxial with a longitudinal axis 61 of the first vapor delivery means 50. The coupling piece 60 is connected to the retaining portion 56 of the connection means 54 by means of locking tags 63 and 64. Furthermore, a cover part 65 of the coupling means 59 is connected to the coupling piece 60, which cover part on the one hand is connected to the peripheral region of the coupling piece 60 and on the other hand bears on the connection means 54 in the transitional region between the bearing portion 55 and the retaining portion 56. A gasket 66is furthermore connected to the coupling piece 60, which gasket is annular in shape and is wedge-shaped in its inner region, thus being bounded by a first conical boundary surface 67 and a second conical boundary surface 68.

The first vapor delivery nozzle 52 of the first vapor delivery means 50 is retained in the first vapor delivery means 50 by a nozzle holder 69. The nozzle holder 69 has a substantially cup-type shape and comprises a side wall 70 forming a hollow cylinder and a bottom wall 71, by means of which the first vapor delivery nozzle 52 is retained. The nozzle holder 69 is provided with an annular projection 72 which is substantially conical in cross-section in the region of the side wall 70, which projection has a conical boundary surface 73 which is designed and constructed for cooperating with the first conical boundary surface 67 of the gasket 66. Passages 74 and 75 are provided in the projection 72 parallel to the direction of the longitudinal axis 61, each forming a water return channel or part of such a water return channel.

The projection 72 bears with its free end facing away from the side wall 70 on the sleeve-shaped retaining portion 56 of the connection means 54. In addition, the hollow cylindrical side wall 70 of the nozzle holder 69 is supported by two guide ribs 76 and 77 which project radially inwards from the retaining portion 56. Thus the nozzle holder 69 and the first vapor delivery nozzle 52 retained thereby are supported with adjustment possibility parallel to the longitudinal axis 61, i.e. between an operational forward position shown in FIG. 2 and a non-operational rear position shown in FIG. 3.

A helically coiled compression spring 78 is passed over the side wall 70 of the nozzle holder 69 and is supported at one end against a step in the side wall 70 and at the other end against stops 79 which are provided in the interior of the retaining portion 56. The compression spring 78 loads the nozzle holder 69 resiliently in the direction of an arrow A1 so that the compression spring 78 will always strive to keep the nozzle holder 69 and the first vapor delivery nozzle 52 retained thereby in the forward operational position. The compression spring 78 ensures that the conical boundary surface 73 of the projection 72 will bear on the conical first boundary surface 67 of the gasket 66 when the nozzle holder 69 is held in its forward operational position, so that in this case the interior of the first vapor delivery means 50, and accordingly the interior of the facial sauna 1, is sealed off from the surroundings of the facial sauna 1, and a connection through which the water vapor generated in the facial sauna 1 can flow out is available through the first vapor delivery nozzle 52 only.

As is apparent from FIG. 3, the second vapor delivery means 51 comprises a tubular part 80 which is arranged so as to be coaxial with a longitudinal axis 81 of the first vapor delivery means 51. The tubular part 80 is here accommodated in a sleeve-type housing part 92. The sleeve-type housing part 92 comprises a plate-shaped closing piece 82 at its end referenced E4 by means of which the second vapor delivery nozzle 53 is retained. Retaining ribs 83 are provided in the region of the closing piece 82 by means of which the tubular part 80 is positioned and retained in the region of its one end 84. In the region of its other end 85, the tubular part 80 is positioned and retained by means of positioning ribs 86 of a closing part 87. The closing part 87 is accommodated in the sleeve-shaped housing part 92.

The second vapor delivery means 51 also comprises coupling means 88 in the region of its end referenced E3, as is the case in a similar manner with the first vapor delivery means 50, where the coupling means 59 are provided. The coupling means 88 of the second vapor delivery means 51 are designed for coupling to the coupling means 59 of the first vapor delivery means 50. In the present case, the coupling means 88 of the second vapor delivery means 51 consist of a tubular part 89 which projects parallel to the longitudinal direction 81 of the closing part 87 in outward direction. The tubular part 89 has an outer diameter which is adapted to fit the inner diameter of the passage 62 in the coupling piece 60 of the coupling means 59 of the first vapor delivery means 50, such that the tubular part 89 can be inserted into the passage 62. The tubular part 89 is provided at its free end with a sloping portion 91 which is designed and constructed for cooperating with the second conical boundary surface 68 of the gasket 66 of the first vapor delivery means 50. The coupling means 88 of the second vapor delivery means 51 further comprise an adjustment stud 90 which projects parallel to the longitudinal direction 81 from the tubular part 89 in outward direction and which is designed and constructed for cooperating with the nozzle holder 69 of the first vapor delivery means 50. It is visible in FIG. 3 that the adjustment stud 90 is the means by which the nozzle holder 69 and the vapor delivery nozzle 52 retained thereby can be set into their non-operational position and are kept in their non-operational position when the vapor delivery means 50 and 51 are coupled to one another.

As is apparent from FIG. 3, the two vapor delivery means 50 and 51 can be coupled to one another by the coupling means 59 of the first vapor delivery means 50 and the coupling means 88 of the second vapor delivery means 51. To achieve such a coupling, the second vapor delivery means 51, which is deposited in the receptacle 7 of the housing 2 and kept therein when not in use, as shown in the Figure, is inserted and pushed home into the first vapor delivery means 50 parallel to the two longitudinal axes 81 and 61, in which case the two coupling means 59 and 88 come into operational contact with one another and the nozzle holder 69 and the first vapor delivery nozzle 52 held thereby are shifted into their nonoperational position shown in FIG. 3 by means of the adjustment stud 90 of the coupling means 88 of the second vapor delivery means 51, i.e. against the force of the compression spring 78. When the vapor delivery means 50 and 51 are coupled or connected to one another, the sloping portion 91 of the tubular part 89 of the coupling means 88 of the second vapor delivery means 51 bear directly on the second conical boundary surface 68 of the gasket 66 of the first vapor delivery means 50 such that a sealed joint is obtained between the two vapor delivery means 50 and 51, whereby it is advantageously achieved that, with the vapor delivery means 50 and 51 coupled to one another, water vapor supplied from the vapor chamber 28 of the facial sauna 1 to the first vapor delivery means 50 through the vapor outlet 43 is passed on from the first vapor delivery means 50 to the second vapor delivery means 51, so that this water vapor can be delivered exclusively by the second vapor delivery means 51, i.e. through the second vapor delivery nozzle 53 of the second vapor delivery means 51.

As is visible in FIGS. 1 and 2, the situation in the facial sauna 1 is such that the first vapor delivery nozzle 52 is at a first distance L1 from the vapor outlet 43 when the first vapor delivery means 50 is connected to the vapor outlet 43, which distance L1 is measured from the pivot axis 52 up to the end of the first vapor delivery nozzle 52 which gives off the water vapor in the present case. As is apparent from FIG. 3, furthermore, the second vapor delivery nozzle 53 is at a second distance L2 from the vapor outlet 43 when the second vapor delivery means 51 is connected to the vapor outlet 43, which connection is achieved by means of the first vapor delivery means 50. The second distance L2 is advantageously greater here than is the distance L1. In the present case, the second distance L2 is greater than the first distance L1 by a factor 5. The second distance L2 may alternatively be greater than the first distance L1 by only a factor 2. The construction may alternatively be such, however, that the second distance L2 is greater than the first distance L1 by a factor 10, or an even greater factor, if so desired. It was found in experiments that a distance L1 of approximately 20 mm and a distance L2 of approximately 100 mm are very advantageous, but that also values between 10 mm and 30 mm and between 50 mm and 200 mm, respectively, are favorable in certain circumstances.

Both the first vapor delivery nozzle 52 of the first vapor delivery means 50 and the second vapor delivery nozzle 53 of the second vapor delivery means 51 are made of metal, i.e. of aluminum, preferably of nickel-plated aluminum. An embodiment made of copper or stainless steel is also possible. Both when water vapor is introduced into the surroundings of the facial sauna 1 through the first vapor delivery nozzle 52 and when water vapor is introduced into the surroundings of the facial sauna 1 through the second vapor delivery nozzle 53, it is possible for water to be condensed in the region of the outer wall of the relevant vapor delivery nozzle 52 or 53. It should be ensured for this case that the condensed water generated can return into the reservoir configuration 9 of the facial sauna 1. This is safeguarded without any further measures in the case of the first vapor delivery nozzle 52, because condensed water formed on the first vapor delivery nozzle 52 can flow back through the nozzle holder 69, the bearing portion 55 of the connection means 54, and the vapor outlet 43 into the interior of the facial sauna 1. To ensure such a return flow of any condensed water formed also in the case of the second vapor delivery means 51, passages 74 and 75 serving as water return channels are provided in the first vapor delivery means 50, i.e. in the conical annular projection 72. These two water return channels 74 and 75 are closed by means of the nozzle holder 69 and the gasket 66 when the nozzle holder 69 is in its operational position, as is apparent from FIG. 2. By contrast, as shown in FIG. 3, the two water return channels 74 and 75, both not visible in FIG. 3, are opened by the nozzle holder 69 when the nozzle holder 69 is in its non-operational position, because the nozzle holder 69 is lifted with its conical annular projection 72 off the gasket 66. In this case, any condensed water formed on the second vapor delivery nozzle 53 can be conducted through the tubular part 80 into the first vapor delivery means 50, then enter the sleeve-shaped retaining portion 56 of the connection means 54 through the two water return channels 74 and 75 in the first vapor delivery means 50, and from there enter the interior of the facial sauna 1 via the bearing portion 55 of the connection means 54 and the vapor outlet 43.

It is possible in a particularly simple manner with the facial sauna 1 to provide either water vapor in the form of a thicker vapor jet by means of the first vapor delivery means 50 or to provide water vapor in the form of a thinner vapor jet by means of the second vapor delivery means 51, for which second possibility it suffices to introduce the second vapor delivery means 51 into the first vapor delivery means 50 without the first delivery means 50 having to be taken off the facial sauna 1. The different distances L1 and L2 of the two vapor delivery nozzles 52 and 53 of the two vapor delivery means 50 and 51 from the vapor outlet 43 safeguard a satisfactory, well-aimed application of water vapor to an envisaged facial zone at all times, while at the same time the possibility of assuming and maintaining a pleasant and comfortable body position is safeguarded.

The invention is not limited to the embodiment of the facial sauna as described above. A facial sauna may also be constructed such that the first vapor delivery means for the generation of a thicker vapor jet can be taken off the facial sauna so as to be able to connect the second vapor delivery means for the generation of a thinner vapor jet to the facial sauna. The two vapor delivery means 50 and 51 each comprise a vapor delivery nozzle 52 and 53 formed by a separate metal part in the embodiment of the facial sauna as described above. An embodiment may alternatively be chosen, however, in which the vapor delivery nozzles of the vapor delivery means are not formed by separate parts but in which the first vapor delivery nozzle of the first vapor delivery means is formed, for example, as part of the nozzle holder and in this case is made of synthetic resin, and in which the second vapor delivery nozzle of the second vapor delivery means is formed by part of a sleeve-type housing portion to whose substantially cup-shaped closing piece the second vapor delivery nozzle is integrally joined, in which case it also is made of synthetic resin. A second vapor delivery means of a facial sauna according to the invention may alternatively be constructed in the form of a hose which can be connected by its first end to the first vapor delivery means and which comprises a second vapor delivery nozzle at its other end, which nozzle then again may be made from metal or synthetic resin. Preferably, however, such a hose provided as a second vapor delivery means may also be provided with an integrated heating device so as to prevent an undesirable water condensation inside the hose, or at least reduce it substantially. Such a hose offers the advantage that it may be particularly long and can be easily readjusted by hand such that the second vapor delivery nozzle provided at its free end can be very accurately aimed at certain skin portions, as desired.

What is claimed is:

1. A facial sauna designed for generating and supplying water vapor for the treatment of facial skin, said sauna comprising a vapor outlet and fitted with at least two vapor delivery means which are connected to the vapor outlet and through which the water vapor is supplied in different manners, wherein:

a first vapor delivery means and a second vapor delivery means are each constructed for delivering water vapor in the form of a vapor jet, the first vapor delivery means comprises a first vapor delivery nozzle for delivering water vapor in the form of a first vapor jet with a first diameter, the second vapor delivery means comprises a second vapor delivery nozzle for the delivery of water vapor in the form of a second vapor jet with a second diameter smaller than that of the first vapor jet, the first vapor delivery nozzle is at a first distance from the vapor outlet when the first vapor delivery means is connected to the vapor outlet, the second vapor delivery nozzle is at a second distance from the vapor outlet when the second vapor delivery means is connected to the vapor outlet, and the second distance is greater than the first distance.

2. A facial sauna as claimed in claim 1, wherein the second distance is greater than the first distance by a factor which lies in a range from 2 to 10.

3. A facial sauna as claimed in claim 2, wherein the second distance is greater than the first distance by a factor 5.

4. A facial sauna as claimed in claim 1, wherein the first vapor delivery means comprises connection means for connection to the vapor outlet at its first end, the first vapor delivery means comprises coupling means at its other end, the second vapor delivery means also comprises coupling means at its one end which are designed for mating with the coupling means of the first vapor delivery means, the two vapor delivery means are coupled to one another by means of the coupling means of the first vapor delivery means and the coupling means of the second vapor delivery means, and water vapor is delivered exclusively through the second vapor delivery means when the vapor delivery means are coupled to one another.

5. A facial sauna as claimed in claim 4, wherein the first vapor delivery nozzle is retained in the first vapor delivery means by means of a nozzle holder, in that the nozzle holder and the first vapor delivery nozzle retained thereby are adjustable between a forward operational position and a non-operational rear position compressed against the force of spring means parallel to the longitudinal direction of the nozzle, and in that the nozzle holder and the first vapor delivery nozzle retained thereby are kept in their non-operational position when the vapor delivery means are coupled to one another.

6. A facial sauna as claimed in claim 5, wherein at least one water return channel is provided in the first vapor delivery means, in that the at least one water return channel is closed by the nozzle holder when the nozzle holder in its operational position, and in that the at least one water return channel is opened by the nozzle holder when the nozzle holder is in its non-operational position.

* * * * *